US006357629B1

(12) United States Patent
Ding

(10) Patent No.: US 6,357,629 B1
(45) Date of Patent: Mar. 19, 2002

(54) WATERPROOF MECHANISM FOR EMULSION DISPENSING PUMP

(76) Inventor: Yaowu Ding, Room 104, Building 10, Lan Yuan, Yan Ling Village, Taixing-Jiangau, 225400 (CN)

( * ) Notice: Subject to any disclaimer, the term of this patent is extended or adjusted under 35 U.S.C. 154(b) by 0 days.

(21) Appl. No.: 09/582,319

(22) PCT Filed: Dec. 8, 1998

(86) PCT No.: PCT/CN98/00287

§ 371 Date: Jul. 18, 2000

§ 102(e) Date: Jul. 18, 2000

(87) PCT Pub. No.: WO99/33575

PCT Pub. Date: Jul. 8, 1999

(30) Foreign Application Priority Data

Dec. 25, 1997 (CN) ..... 97243110

(51) Int. Cl.[7] ..... B05B 11/00

(52) U.S. Cl. ..... 222/153.13; 222/321.1; 222/321.9; 222/384; 222/385

(58) Field of Search ..... 222/153.13, 153.14, 222/321.1, 321.3, 321.7, 321.8, 321.9, 383.3, 384, 385

(56) References Cited

U.S. PATENT DOCUMENTS 5,492,251 A * 2/1996 Albini et al. ..... 222/153.13
5,549,223 A * 8/1996 Hori ..... 222/153.13
5,738,250 A * 4/1998 Gillingham et al. ... 222/153.13
5,806,721 A * 9/1998 Tada ..... 222/153.13

FOREIGN PATENT DOCUMENTS

| | | | |
|---|---|---|---|
| CN | 1145609 | A | 3/1997 |
| EP | 0 613 728 | A2 | 9/1994 |
| EP | 0 685 269 | A2 | 12/1995 |
| EP | 0 696 478 | A1 | 2/1996 |
| EP | 0 737 518 | A1 | 10/1996 |

* cited by examiner

*Primary Examiner*—J. Casimer Jacyna
(74) *Attorney, Agent, or Firm*—Merchant & Gould P.C.

(57) ABSTRACT

An emulsion pump mechanism for preventing external dirty water from entering the emulsion bottle is described. The pump mechanism includes a pressing head having an internal passage. At the lower end of the passage there is a pipe connector on the outer wall of which is an external thread. Additionally, the pump includes a connecting pipe communicated with the internal passage of the pressing head. The pump mechanism also includes a cylinder cover. The cylinder cover includes a dirty water preventing guiding sleeve pipe integrally formed in a lower portion of the central through-hole for preventing dirty water from entering the emulsion bottle. The guiding sleeve pipe is in easy slide fit with the outer wall of the connecting pipe and has an upper end extending higher than an upper surface of the cylinder cover.

2 Claims, 1 Drawing Sheet

WATERPROOF MECHANISM FOR EMULSION DISPENSING PUMP

FIELD OF THE INVENTION

The present invention relates to an emulsion pump mechanism which prevents dirty water from entering an emulsion bottle.

BACKGROUND OF THE INVENTION

There is a kind of commercially available chemical emulsion bottle on which is provided an emulsion pump. This pump has a pressing head, a connecting pipe and a cylinder cover. Among them, the pressing head has an internal through-hole with a pipe connector at its lower end, and the upper end of the connecting pipe is fixedly joined to the pipe connector, and communicated with the through-hole in the pressing head. In addition, the outer wall of the connecting pipe is in easy slide fit with the central through-hole of the cylinder cover. In order that the air pressure inside and outside of the bottle will be balanced when emulsion is taken out of the bottle, a clearance must be provided between the central through-hole of the cylinder cover and the outer wall of the connecting pipe so that air can flow in and out. Furthermore, in order that the pressing head can be kept relatively fixed with the cylinder cover after the pressing head is pressed down, in the upper portion of the central through-hole of the cylinder cover is arranged with an internal thread to be engaged with the thread on the outer wall of the pipe connector of the pressing head, hence, in the upper portion of the central through-hole of the cylinder cover there is formed a recessed cylindrical space. In this way, when in operation, the external dirty water will be often accumulated in the recessed space, and will flow into the emulsion bottle along the wall of the connecting pipe, thereby the emulsion in the bottle is contaminated.

SUMMARY OF THE INVENTION

The purpose of the present invention is to provide an emulsion pump mechanism which can prevent dirty water from entering the pump (bottle), this mechanism can not only balance air pressure inside and outside of a bottle, but also prevent dirty water from entering the emulsion bottle.

The purpose of the present invention is realized by the following technical solution. The present invention provides a kind of emulsion pump mechanism which can prevent dirty water from entering emulsion bottle. This mechanism comprises a pressing head, a connecting pipe and a cylinder cover. In the pressing head there is a (through) passage, at the lower end of the passage is a pipe connector, on the outer wall of which is provided with an outer thread. The upper end of the connecting pipe is fixed on the pipe connector of the pressing head and the connecting pipe is communicated with the internal passage of the pressing head. In the center of the cylinder cover there is a through-hole for the passage of the connecting pipe, in the upper portion of the said central through-hole there is provided an internal thread capable of being engaged with the outer thread of the pipe connector. On the lower wall of the central through-hole of the cylinder cover is formed integrally a guiding sleeve pipe for preventing dirty water from entering the emulsion bottle. The inner wall of the said guiding sleeve pipe for preventing dirty water from entering the emulsion bottle is in easy slide fit with the outer wall of the connecting pipe and the upper end of the water preventing guiding sleeve pipe is higher than the upper surface of the cylinder cover.

The further improvement of the present invention is that the connecting pipe has an upper end with reduced outer diameter, while the pipe connector of the said pressing head comprises an inner pipe and an outer pipe, the inner wall of the inner pipe is fixedly connected with the upper end of the connecting pipe, the outer diameter of the inner pipe is of the same outer diameter as that of the rest portion of the connecting pipe and the said outer thread is provided on the outer wall of the said outer pipe, and a hollow annular space is provided between the said inner pipe and the said outer pipe for the insertion of the said dirty water preventing guiding sleeve pipe.

The advantages of the present invention is that, due to the fact that a dirty water preventing guiding sleeve pipe is provided in the central through-hole of the cylinder cover, the dirty water can be prevented from flowing into the emulsion bottle. In addition, simple improvements are made to the pipe connection of the pressing head and the connecting pipe, thereby assuring that the emulsion pump still has the excellent sealed state.

BRIEF DESCRIPTION OF THE DRAWING

The concrete structure of the present invention is given by the following embodiment and the accompanying drawing.

DETAILED DESCRIPTION OF THE INVENTION

Figure 1:
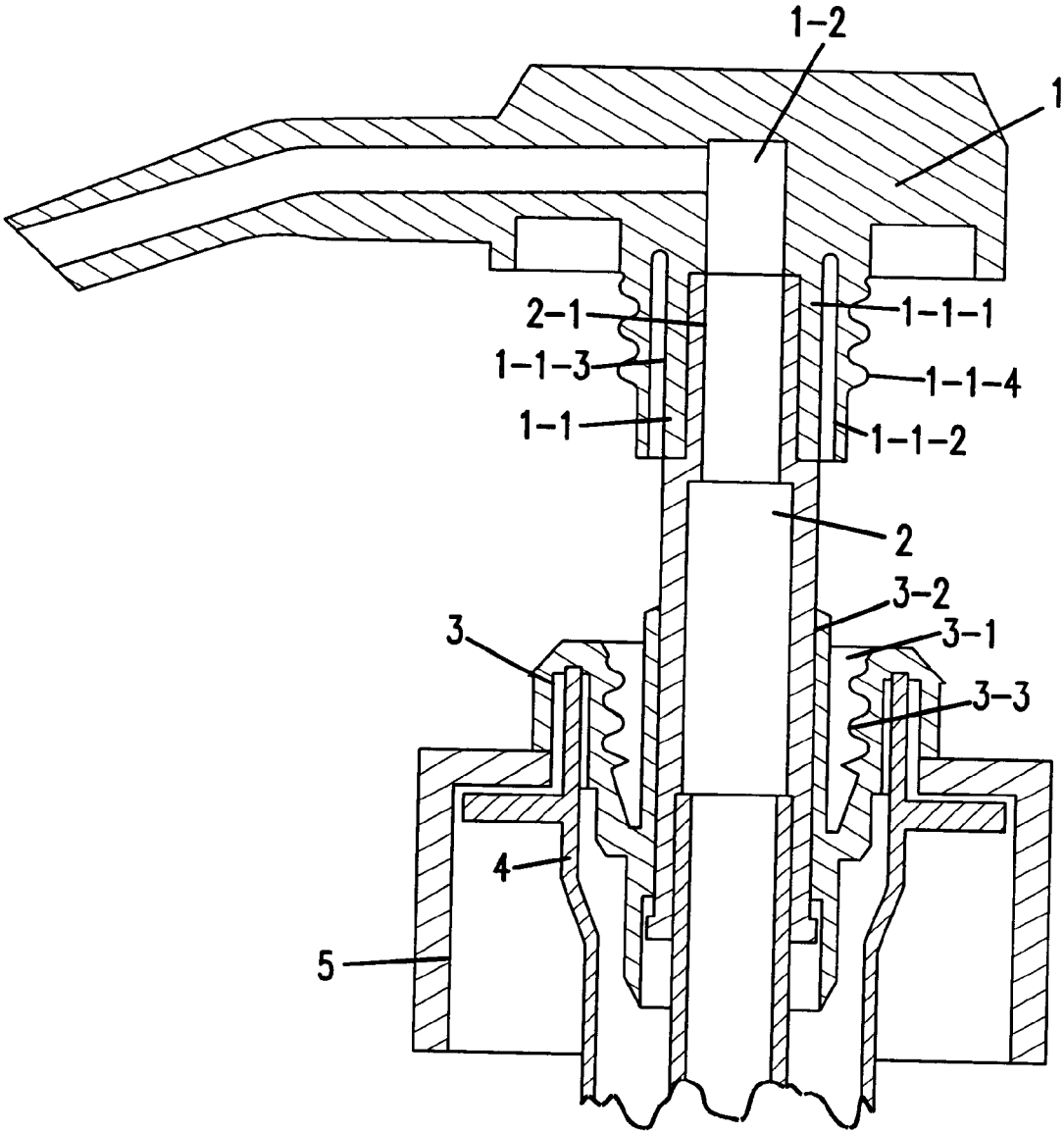
FIG. 1. is a schematic view of the structure of the emulsion pump mechanism for preventing dirty water from entering an emulsion bottle according to the present invention.

Please refer to FIG. 1, the emulsion pump mechanism includes a pressing head 1, a connecting pipe 2 and a cylinder cover 3. The pressing head has a passage 1-2, at the lower end of the passage 1-2 is a pipe connector 1-1 which comprises an inner pipe 1-1-1 and an outer pipe 1-1-2, an outer thread 1-1-4 is provided on the outer wall of the outer pipe, and between the inner and the outer pipe there is a hollow annular space 1-1-3.

The outer diameter of the upper end 2-1 of the connecting pipe 2 is reduced and the said upper end 2-1 is fixedly connected with the inner wall of the inner pipe 1-1-1 and the outer diameter of the rest portion of the connecting pipe 2 is the same as that of the outer diameter of the inner pipe 1-1-1.

The said cylinder cover 3 has a central through-pole 3-1, in the lower portion of the central through-hole there is formed integrally a dirty water preventing guiding sleeve pipe 3-2 which is used to prevent external dirty water from entering the emulsion bottle. The inner wall of said dirty water preventing guiding sleeve pipe 3-2 is in easy slide fit with the outer wall of the connecting pipe 2, and the upper end of the said dirty water preventing guiding sleeve pipe is higher than the upper surface of the cylinder cover 3.

In addition, in the upper portion of the central through-hole 3-1 there is provided an inner thread 3-3 which can be engaged with the outer thread 1-1-4 on the pressing head 1.

When the pressing head is pressed down, the upper end of the dirty water preventing guiding sleeve head 3-2 can be inserted into the hollow annular space 1-1-3 between the inner pipe 1-1-1 and the outer pipe 1-1-2. At this time, turning the pressing head 1 can make the outer thread 1-1-4 on the pipe connector be engaged with the internal thread 3-3 of the central through-hole, thereby the pressing head 1 and the cylinder cover 3 can be kept relatively fixed, while making the emulsion pump to be in sealed state.

The reference numeral 4 in FIG. 1 denotes the cylinder and the reference numeral 5 denotes the outer casing, which are the constituent parts of the emulsion pump, and are used together with the emulsion pump mechanism for preventing dirty water from entering the emulsion bottle.

What is claimed is:

1. An emulsion pump mechanism for preventing dirty water from entering an emulsion bottle comprising:

a pressing head comprising an internal passage, wherein at a lower end of the passage there is a pipe connector on the outer wall of which is provided an external thread;

a connecting pipe, wherein an upper end of the connecting pipe is fixed on the piper connector at the lower end of the pressing head and wherein the connecting pipe is communicated with the internal passage of the pressing head; and a cylinder cover comprising a through-hole for the insertion of the connecting pipe, wherein in an upper portion of the through-hole there is an internal thread capable of being engaged with the outer thread on the outer wall of the pipe connector, and wherein a dirty water preventing guiding sleeve pipe is integrally formed in a lower portion of the central through-hole in one piece construction with said cylinder cover for preventing dirty water from entering the emulsion bottle, the guiding sleeve pipe being in easy slide fit with the outer wall of the connecting pipe and having an upper end of the guiding sleeve pipe higher than an upper surface of the cylinder cover.

2. The emulsion pump mechanism according to claim 1, wherein the upper end of the connecting pipe has a reduced outer diameter, and the pipe connector on the lower end of the pressing head comprises an inner pipe secured to the upper end of the connecting pipe, wherein the outer diameter of the inner pipe is equal to the outer diameter of a remaining portion of the connecting pipe, and an outer pipe comprising an outer thread provided on an outer wall, wherein, the pump further comprises a hollow annular space between the inner pipe and the outer pipe for receiving the dirty water preventing guiding sleeve pipe.

* * * * *